US005390826A

United States Patent [19]

Burrows

[11] Patent Number: 5,390,826

[45] Date of Patent: Feb. 21, 1995

[54] BOTTLED WATER STATION WITH REMOVABLE RESERVOIR AND MANIFOLDED SUPPORT PLATFORM

[75] Inventor: Bruce D. Burrows, Valencia, Calif.

[73] Assignee: Ebtech, Inc., Columbus, Ohio

[21] Appl. No.: 202,722

[22] Filed: Feb. 28, 1994

[51] Int. Cl.[6] ..... B67D 5/62

[52] U.S. Cl. ..... 222/146.6; 222/185; 62/390

[58] Field of Search ..... 222/146.1, 146.6, 185; 62/390, 395

[56] References Cited

U.S. PATENT DOCUMENTS

| | | | |
|---|---|---|---|
| 2,657,554 | 8/1951 | Hull | 222/146.1 |
| 3,112,114 | 11/1963 | Jacobs | 277/205 |
| 4,629,096 | 12/1986 | Schroer et al. | 222/146.6 |
| 4,699,188 | 10/1987 | Baker et al. | 222/185 |
| 5,105,858 | 4/1992 | Levinson | 222/185 |
| 5,192,004 | 3/1993 | Burrows | 222/185 |
| 5,246,141 | 9/1993 | Burrows | 222/185 |
| 5,289,951 | 3/1994 | Burrows | 222/146.6 |

FOREIGN PATENT DOCUMENTS

| | | | |
|---|---|---|---|
| 2257116 | 1/1993 | United Kingdom | 222/185 |

*Primary Examiner*—Andres Kashnikow
*Assistant Examiner*—Philippe Derakshani
*Attorney, Agent, or Firm*—Kelly Bauersfeld & Lowry

[57] ABSTRACT

An improved bottled water station is provided of the type including a removable reservoir for drop-in installation into a station housing, wherein the reservoir is adapted for slide-fit engagement with a manifolded support platform for coupling the reservoir to at least one temperature control device and to at least one faucet valve for dispensing. The reservoir is constructed, in the preferred form, from a molded plastic or the like to have an open upper end for receiving and supporting an inverted water supply bottle. The reservoir, upon drop-in installation into the station housing, is supported upon the manifolded support platform, wherein the reservoir and platform include mating slide-fit connectors for coupling the reservoir to temperature control devices such as a chiller probe for chilling water within the reservoir, and/or a hot water tank for heating a portion of the water coupling from the reservoir. The support platform also includes dispenser fittings for connection to faucet valves disposed at the front of the station housing for individual dispensing of water supplies at different temperatures.

18 Claims, 5 Drawing Sheets

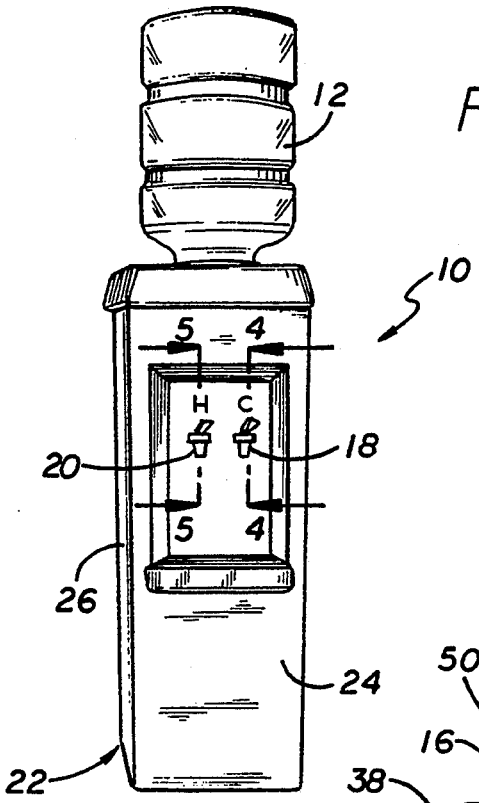
FIG. 1
FIG. 2
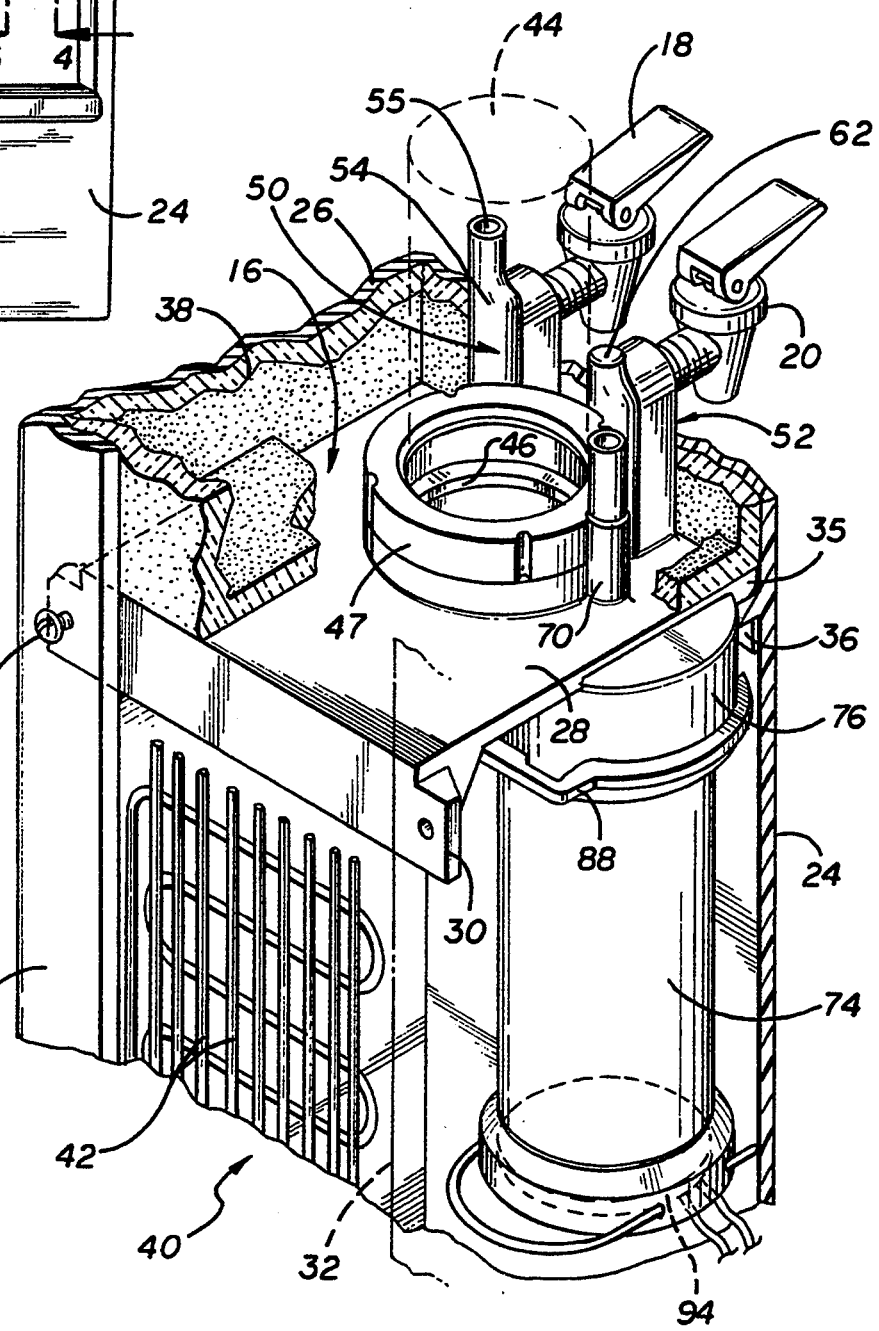

BOTTLED WATER STATION WITH REMOVABLE RESERVOIR AND MANIFOLDED SUPPORT PLATFORM

BACKGROUND OF THE INVENTION

This invention relates generally to bottled water dispenser stations of the type adapted to receive and support a water supply bottle in an inverted position, and to selectively dispense water therefrom. More specifically, this invention relates to an improved bottled water station having a removable reservoir designed for drop-in installation into a station housing, wherein the station housing includes a manifolded support platform for slide-fit engagement with the removable reservoir. The support platform includes the appropriate fittings and/or flow paths for slide-fit connection of the reservoir to one or more temperature control devices, and dispenser fittings for connection to one or more faucet valves.

Bottled water dispenser stations are well-known in the art for containing a supply of relatively purified water in a convenient manner and location ready for substantially immediate dispensing and use. Such bottled water stations commonly include an upwardly open reservoir mounted on a station housing and adapted to receive and support an inverted water bottle of typically three to five gallon capacity. Water within the inverted supply bottle flows downwardly into the station reservoir for selective dispensing therefrom through a faucet valve located at the front of the station housing. Such bottled water stations are widely used to provide a clean and safe source of water for drinking and cooking, especially in areas wherein the local water supply is suspected to contain undesired levels of contaminants.

In bottled water stations of the above-described type, the water bottles are normally provided in a clean and preferable sterile condition within an appropriate sealed cap to prevent contamination of the water contained therein. When an inverted supply bottle on a station housing reaches an empty condition, the empty bottle can be lifted quickly and easily from the station housing and replaced by a filled bottle having the sealing cap removed therefrom or otherwise opened to permit water downflow. The empty bottle can then be returned to the bottled water vendor for cleaning and refilling.

Although bottled water stations of this type utilize a sequence of water bottles which have been individually sanitized, the water reservoir within the station housing is not subjected to periodic cleaning or replacement. In this regard, the housing reservoir commonly comprises a metal or ceramic tank mounted within the station housing in association with a refrigeration system for maintaining water within the reservoir in a chilled condition. In other station housing designs, an auxiliary reservoir is provided in association with suitable heating elements for providing a heated water supply. Unfortunately, the integration of the station housing reservoir with associated chilling and/or heating systems has generally precluded easy reservoir removal for cleaning purposes. Instead, the housing reservoir has typically been used for prolonged time periods without cleaning, thus creating the potential for undesired growth of harmful bacteria and other organisms. Reservoir cleaning has generally been accomplished by taking the station out of service and returning the station to a centralized facility for cleaning purposes.

In one proposed construction for a bottled water station, a removable reservoir container has been suggested for easy drop-in placement and lift-out removal with respect to a supporting chiller plate within a station housing. See U.S. Pat. No. 4,629,096. While this configuration beneficially permits reservoir removal for cleaning purposes, no provision has been made to supply a desirable heated water supply in addition to a chilled water supply. Moreover, the supported placement of the removable reservoir container onto a refrigerated chiller plate inherently and undesirably provides a large surface area and associated space conducive to frost and/or condensation buildup between the chiller plate and the reservoir container.

U.S. Pat. No. 5,192,004 discloses an improved bottled water station of the type having a removable reservoir, wherein multiple temperature water supplies are provided and significant condensation problems at the exterior of the reservoir are overcome. More specifically, a removable reservoir is disclosed for slide-fit reception of a chiller probe directly into the interior of the reservoir, and for separate slide-fit coupling of a water flow to a hot water tank. The requisite slide-fit connections, however, involve various plumbing connections and fittings which must be assembled at the bottom of the removable reservoir and/or within the station housing, resulting in an overall construction which can be relatively complex.

The present invention provides a further improvement in bottled water stations of the type having a slide-fit removable reservoir, wherein slide-fit connections between the reservoir and the station housing are simplified by the provision of a manifolded support platform formed to include fittings and/or flow paths for slide-fit connection of the reservoir to one or more temperature control devices, and to one or more faucet valves for dispensing.

SUMMARY OF THE INVENTION

In accordance with the invention, an improved bottled water station is provided of the type having a removable reservoir for drop-in, slide-fit installation into a station housing, and for receiving and supporting a water supply bottle in an inverted position. The station housing includes a manifolded support platform for receiving and supporting the removable reservoir. The reservoir and support platform include interengageable slide-fit connectors for coupling the reservoir to one or more temperature control devices, such as a chiller probe for chilling water within the reservoir and/or a hot water tank for heating a portion of the water from the reservoir. The support platform also includes dispenser fittings for connecting the individual water supplies at different temperatures to respective faucet valves mounted at the front of the station housing.

In the preferred form of the invention, the support platform includes at least one upwardly projecting flow tube for sealed and slide-fit connection through a flow port formed in the bottom wall of the removable reservoir. The flow tube defines a flow path for water downflow from the interior of the reservoir to a dispenser fitting adapted for connection to a faucet valve at the front of the station housing. In the preferred form, the reservoir additionally defines means for slide-fit reception or engagement with a chiller probe projecting upwardly through the support platform for cooling or chilling water within the reservoir interior.

A second flow tube is desirably provided on the manifolded support platform and projects upwardly therefrom for sealed and slide-fit reception through a second flow port formed in the bottom wall of the reservoir. In one embodiment, the second flow tube defines a flow path for connecting a flow of water from the reservoir to a hot water tank suspended from the support platform and preferably adapted for slide-fit mounting thereto. The hot water tank includes heater means for producing a hot water supply which is connected back through the support platform via a slide-fit connected discharge tube to a second dispenser fitting adapted for mounting of a second faucet valve. In an alternative embodiment, the second flow tube is connected by a standpipe within the reservoir to an upper reservoir chamber disposed above a baffle plate, whereby water within the upper reservoir chamber is substantially unchilled by the chiller probe. In this alternative version, the second flow tube defines a flow path directly to the second dispenser fitting and faucet valve associated therewith for dispensing of water substantially at room temperature.

The manifolded support platform, including the flow tubes and associated dispenser fittings, is preferably constructed as a unitary molding of lightweight plastic or the like. The platform includes means for fixed installation within the station housing to receive and support the removable reservoir. When a hot water tank is provided, a mounting cap is formed at the underside of the platform for removable slide- fit connection and suspended support of the hot water tank.

Other features and advantages of the present invention will become more apparent from the following detailed description, taken in conjunction with the accompanied drawings, which illustrate, by way of example, the principles of the invention.

BRIEF DESCRIPTION OF THE DRAWINGS

The accompanying drawings illustrate the invention. In such drawings:

FIG. 1 is a front perspective view illustrating a bottled water dispenser station adapted for use with the manifolded support platform embodying the novel features of the invention;

FIG. 2 is an enlarged fragmented rear side perspective view illustrating the manifolded supported platform mounted within a station housing;

DETAILED DESCRIPTION OF THE PREFERRED EMBODIMENTS

Figure 3:
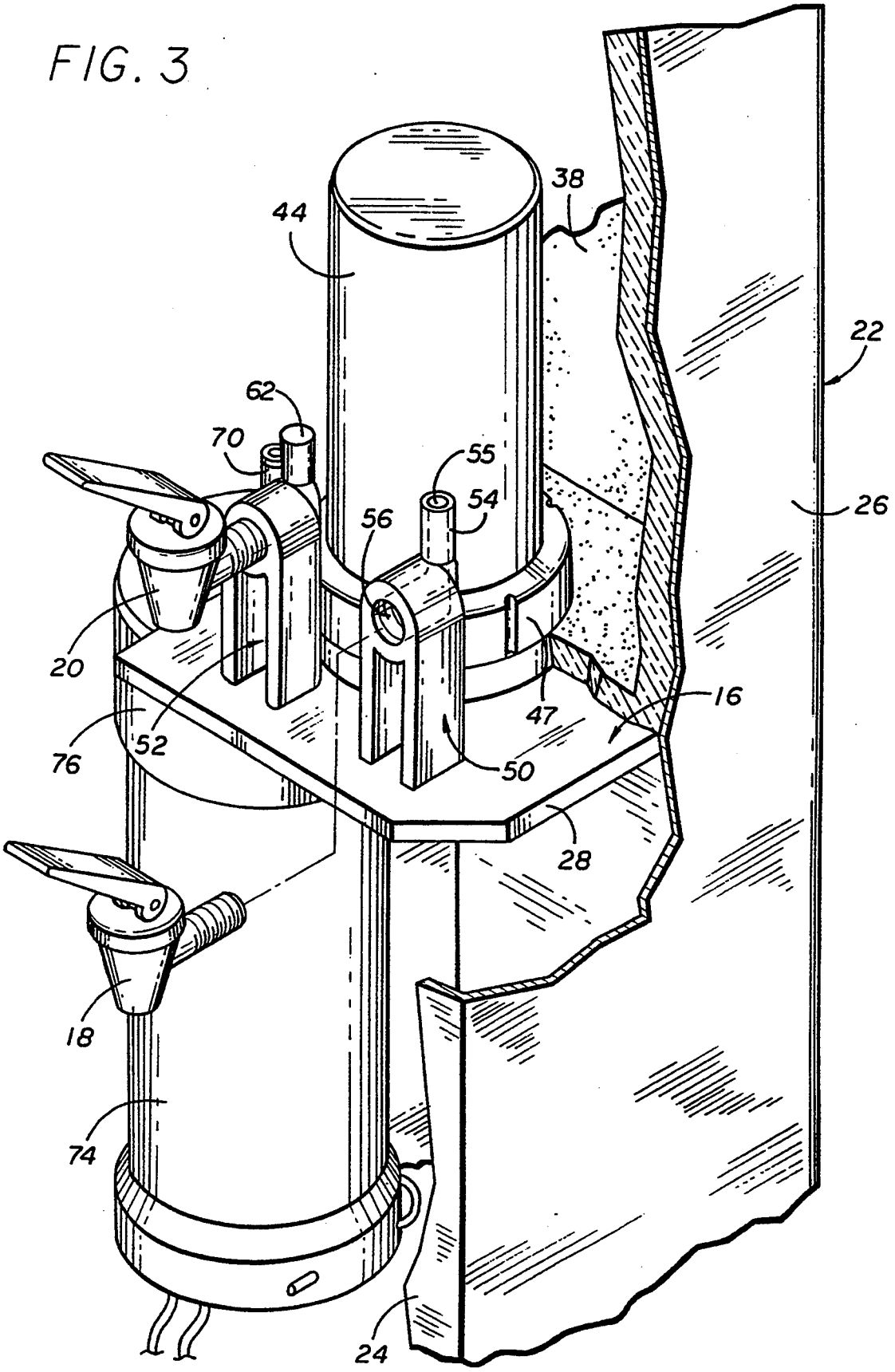
FIG. 3 is an enlarged fragmented front side perspective view of the manifolded support platform mounted within the dispenser station housing.

As shown in the exemplary drawings, a bottled water dispenser station referred to generally in FIG. 1 by the reference numeral 10 is provided for receiving and supporting a water bottle 12 containing a supply of relatively purified water for drinking and cooking uses, etc. The bottled water station 10 includes a removable reservoir 14 (FIGS. 3 and 4) for receiving and supporting the water bottle 12, wherein the reservoir 14 can be removed quickly and easily as required for purposes of cleaning or replacement. The removable reservoir 14 is supported in turn by a manifolded support platform 16 (FIGS. 2–4) adapted to establish the necessary plumbing connections between the reservoir 14 and associated faucet valves 18 and 20 upon drop-in installation of the reservoir.

The illustrative bottled water station 10 has a generally conventional overall size and shape to include an upstanding station housing 22. The station housing 22, in combination with the reservoir 14, supports the water bottle 12 in an inverted orientation such that water contained therein will flow downwardly by gravity into the interior of the reservoir 14. In accordance with the present invention, the reservoir 14 and support platform 16 include interegageable slide-fit connectors for coupling the reservoir water to at least one temperature control device and also to at least one faucet valve for dispensing. In addition, the support platform 16 provides the requisite flow connections and flow paths for dispensing water from the faucet valves 18 and 20 at different selected temperature levels. The manifolded support platform 16 provides a relatively simple structure which may be formed as a unitary plastic molding to provide the dual functions of supporting the reservoir 14 and water contained therein, while additionally forming the necessary flow paths for delivering water to the faucet valves 18, 20.

With reference to FIGS. 1–3, the station housing 22 is shown with an upstanding, generally rectangular configuration to include a front wall 24 joined to a pair of housing side walls 26, and a housing back which has a typically open construction (FIG. 2). The support platform 16 is mounted within the station housing to define a generally horizontal shelf 28 disposed at a position spaced downwardly from the housing upper end. As shown in FIG. 2, the platform 16 includes a downturned rear flange 30 adapted for secure attachment to side edge strips 32 extending along the rear edges of the side walls 26, wherein the rear flange 30 is securely attached to the side strips 32 by mounting screws 34 or the like. A forward edge 35 of the platform 16 is rested upon an internal rib or bracket 36 or the like at the inboard side of the housing front wall 24. The platform 16 cooperates with the front and side walls of the station housing 22 to define an upwardly open cavity for drop-in reception of the removable reservoir 14, as will be described in more detail. This upwardly open cavity is normally lined with insulation material 38.

A refrigeration system 40 is normally mounted within the station housing to include a compressor (not shown) located below the support platform 16 and finned heat transfer tubing 42 mounted across the open back of the station housing 22 (FIG. 2). The illustrative refrigeration system 40 includes a generally cylindrical chiller probe 44 which projects upwardly through an opening 46 in the support platform 16 and is secured thereto by a threaded mounting ring 47. The interior of the chiller probe 44 carries a chiller coil 48 for purposes of reducing the temperature of water within the reservoir 14, as will be described in more detail. For improved heat transfer between the chiller coil 48 and the probe 44, the residual internal volume of the probe is preferably filled with a heat transfer gel or mastic material 49, as described and claimed in U.S. Pat. No. 5,246,141, which is incorporated by reference herein with respect to further constructional and mounting details of the chiller probe.

A pair of dispenser fittings 50 and 52 are also formed on the support platform 16 and project upwardly from the shelf 28 at side-by-side positions near the forward edge 35 of the platform. In the preferred form as illustrated in FIGS. 1–5, the first dispenser fitting 50 includes an upwardly projecting flow tube 54 which defines a short flow path 55 (FIG. 4) in communication with a threaded bore 56 adapted in turn for thread-in mounting of the faucet valve 18. The second dispenser fitting 52 defines a second flow tube 57 forming a second flow path 58 (FIG. 5) extending downwardly through the support platform 16, and also communication with a threaded bore 60 for thread-in mounting of the second faucet valve 20. For ease of production by injection molding, the upper end of the flow tube 57 is initially open, but closed by a plug 62 prior to installation of the platform 16 into the station housing.

Figure 4:
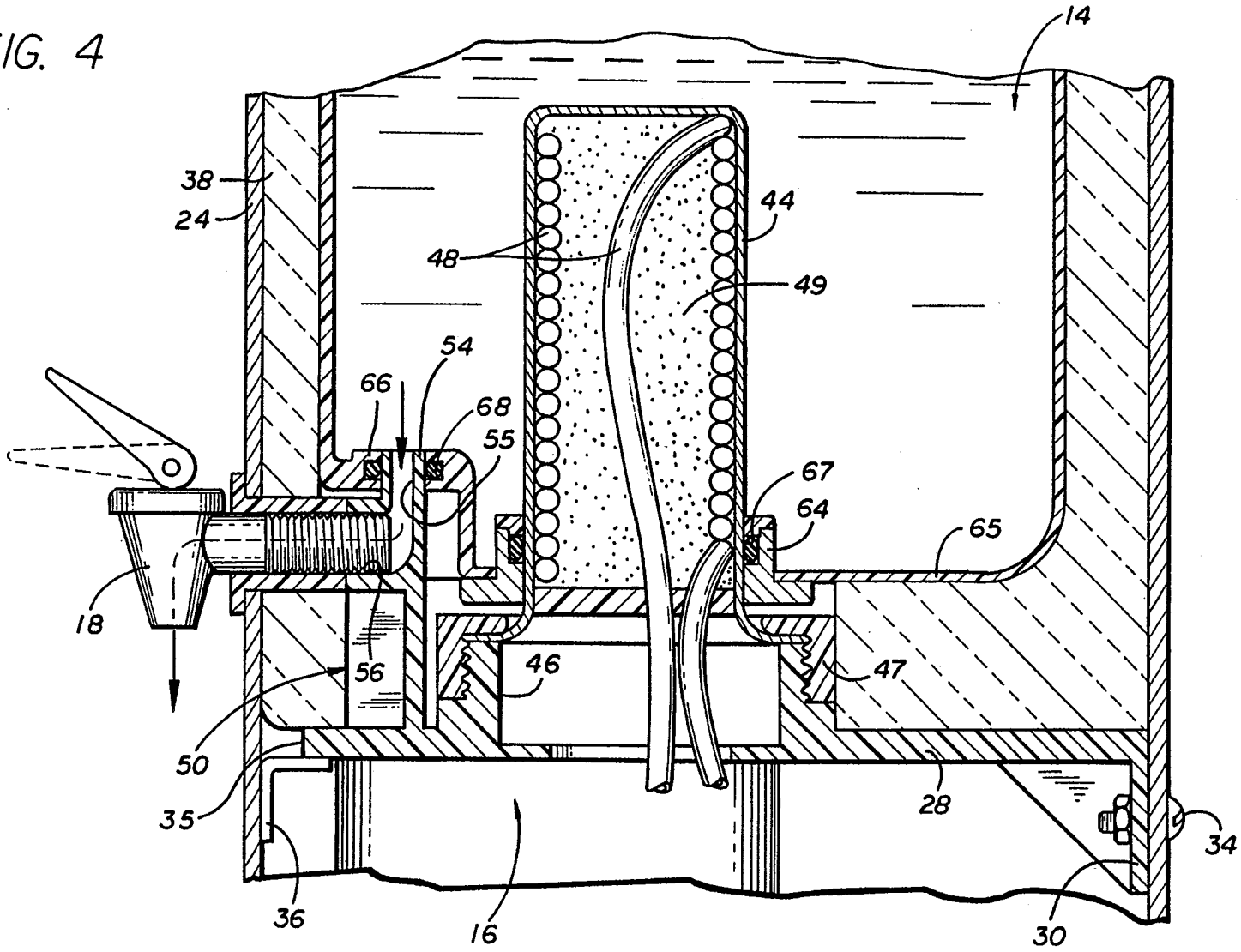
FIG. 4 is an enlarged fragmented vertical sectional view taken generally on the line 4—4 of FIG. 1.

As shown in FIG. 4, drop-in installation of the reservoir 14 into the station housing 22 is accompanied by slide-fit reception of the reservoir with the chiller probe 44 and the flow tube 54 associated with the first dispenser fitting 50. More particularly, the reservoir 14 is shown with a seal collar 64 formed in a bottom wall 65 thereof for slide-fit and fluid-tight sealed reception of the chiller probe 44 into a lower region of the reservoir interior. At the same time, a flow port 66 formed in the bottom of the reservoir 14 is slide-fitted about the upper end of the upstanding flow tube 54. Appropriate seal rings 67 and 68 respectively seal the passage of the chiller probe 44 and the flow tube 54 into the reservoir interior. With this construction, water within the lower portion of the reservoir is cooled by the chiller probe 44, and that chilled water is adapted for direct dispensing via the dispenser fitting 50 and associated faucet valve 18. Alternately, if desired, the illustrative reservoir construction wherein the chiller probe 44 protrudes directly into the reservoir interior may be modified to provide an inverted receiver cup for slide-fit reception of the chiller probe at the bottom exterior of the reservoir. This receiver cup geometry is described and claimed in U.S. Pat. No. 5,289,951, which is incorporated by reference herein.

Figure 5:
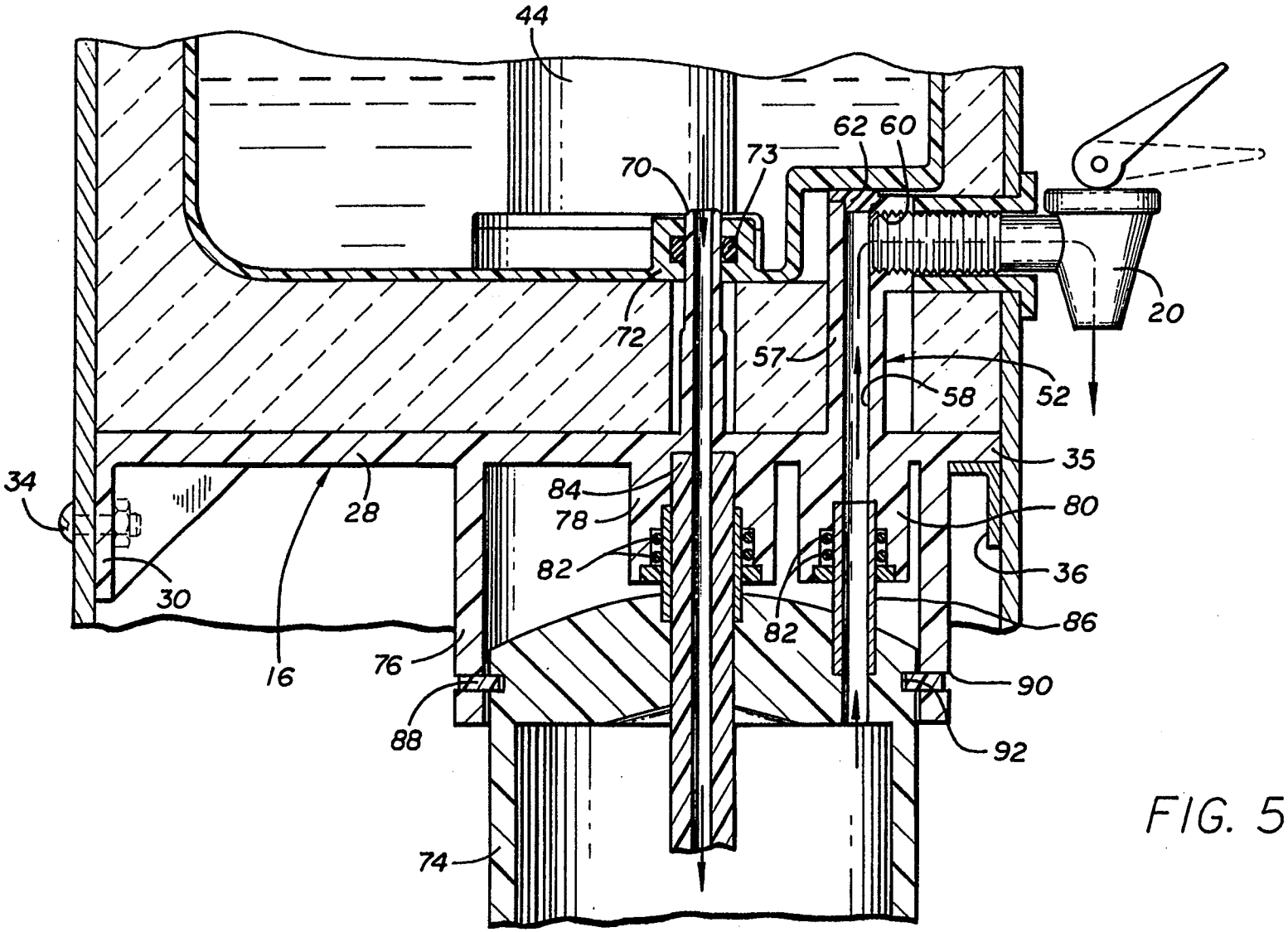
FIG. 5 is an enlarged fragmented vertical sectional view taken generally on the line 5—5 of FIG. 1.

As shown in FIG. 5, a hot water supply tube 70 projects upwardly from the platform 16 for slide-fit reception through a flow port 72 formed in the bottom of the reservoir 14, upon drop-in installation of the reservoir into the station housing. A seal ring 73 within the flow port 72 provides a slide-fit sealed connection, such that a portion of the water within the reservoir can flow downwardly through the platform 16 into a hot water tank 74 suspended below the platform. In general terms, the hot water tank 74 includes means for elevating the temperature of water therein for selective dispensing as a heated water supply via the second faucet valve 20.

More specifically, with reference to FIGS. 2, 3 and 5, the hot water supply tube 70 permits water downflow from the reservoir 14 to the interior of a mounting cap 76 formed as a portion of the manifolded support platform 16. The mounting cap 76 comprises a generally cylindrical and downwardly open structure which circumscribes a pair of smaller tubular fittings 78 and 80 depending from the platform shelf 28. These tubular fittings 78 and 80 are formed in respective flow communication with the hot water supply tube 70 and the flow path 58 associated with the second dispenser fitting 52. Thus, the tubular fittings 78 and 80 provide slide-fit connectors for respectively supplying water to and dispensing water from the hot water tank 74. Both of the tubular fittings 78, 80 are lined by one or more seal rings 82.

The hot water tank 74 is constructed generally as described and claimed in copending U.S. Pat. No. 5,246,141, which is incorporated by reference herein. More particularly, the tank 74 has a generally cylindrical shape with tubular nipples 84 and 86 projecting upwardly for sealed and slide-fit reception respectively into the tubular fittings 78 and 80, when the tank upper end is slide-fitted into the mounting cap 76. A spring clip 88 is removably mounted about the cap 76 to extend through cap slots 90 into tank grooves 92 to retain the hot water tank in an installed position. As electrical resistance heater unit 94 is mounted at the bottom end of the tank to heat the water. In operation, a portion of the water within the reservoir is thus supplied downwardly through the platform and into the tank for heating, followed by dispensing back upwardly via the second dispenser fitting 52 and associated faucet valve 20.

Figure 6:
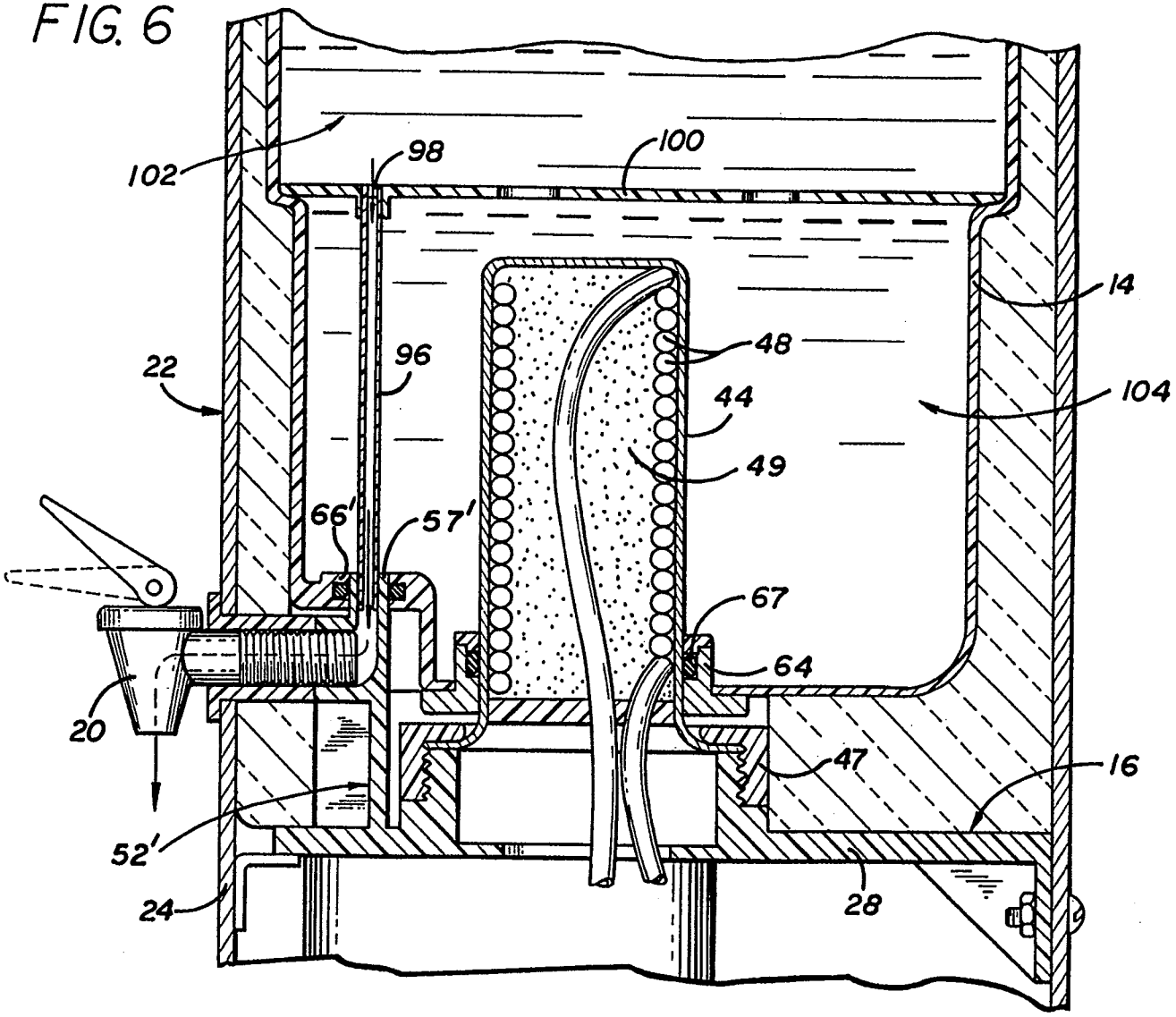
FIG. 6 is an enlarged fragmented sectional view generally similar to FIG. 4, and illustrating one alternative preferred form of the invention.

In one alternative preferred form of the invention, the manifolded support platform 16 can be adapted for dispensing substantially room temperature water via the faucet valve 20 in lieu of hot water by use of the hot water tank 74. More specifically, as shown in FIG. 6, a modified second dispenser fitting 52' may be constructed to include an upstanding flow tube 57' for sealed and slide-fit reception through a flow port 66' in the bottom of the reservoir. A standpipe 96 interconnects this flow port 66' through an aperture 98 formed in a perforated baffle plate 100 which centrally subdivides the interior of the reservoir into upper and lower chambers, 102 and 104, respectively. In this embodiment, the second faucet valve 20 is thus coupled via the dispenser fitting 52' and the standpipe 96 to the upper reservoir chamber 102, with the baffle plate 100 effectively isolating the water within the upper chamber from the cooling effect provided within the lower chamber 104 by the chiller probe 44. Opening of the second faucet valve 20 is thus effective to dispense water at substantially room temperature from the upper chamber 102 of the reservoir.

The manifolded support platform of the present invention thus includes the necessary fittings and plumbing connections, in a simplified and integrated unit, for coupling the removable reservoir 14 in a slide-fit manner with other components of the bottled water station as an incident to drop-in reservoir installations. The support platform provides the dual functions of reservoir support as well as providing the requisite flow paths for coupling water flows at different temperatures to respective faucet valves for dispensing.

It will be understood, of course, that additional modifications and improvements to the bottled water station as described herein are within the scope of skill and normal expertise of a person skilled in the art. For example, a modified bottled water station geometry may be provided to include cold and hot water dispensing as described in FIGS. 1–5, while additionally including a third faucet valve of the type shown in FIG. 6 for dispensing of water at room temperature. Accordingly, no limitation on the invention is intended by way of the foregoing description and accompanying drawings, except as set forth in the appended claims.

What is claimed is:

1. A water station, comprising:

a reservoir having a hollow interior for receiving and storing a supply of water;

a station housing having a support platform for receiving and supporting said reservoir, said reservoir being adapted for slide-fit drop-in installation into said station housing:

said support platform including at least one slide-fit connector for engagement with said reservoir upon drop-in installation of said reservoir into said station housing, said support platform further including at least one dispenser fitting and defining a flow path extending from said slide-fit connector to said dispenser fitting, said flow path being in communication with the reservoir interior upon drop-in installation of said reservoir into said station housing; and a faucet valve mounted on said dispenser fitting in an accessible position for manual operation to dispense water from said reservoir.

2. The water station of claim 1 wherein said support platform comprises a unitary plastic molding.

3. The water station of claim 1 wherein said support platform further includes means for supporting at least one temperature control device in thermal communication with water within the interior of said reservoir.

4. The water station of claim 3 wherein said temperature control device comprises a chiller probe supported by said platform to project upwardly therefrom.

5. The water station of claim 1 wherein said faucet valve is disposed at the exterior of the station housing.

6. The water station of claim 1 wherein said reservoir is adapted to receive and support a water supply bottle in an inverted position when said reservoir is installed within said station housing.

7. The water station of claim 1 wherein said at least one slide-fit connector comprises a first slide-fit connector, and said support platform further including a second slide-fit connector for engagement with said reservoir upon drop-in installation thereof into said station housing, a second dispenser fitting on said support platform, a hot water tank mounted on said support platform, said second slide-fit connector defining a flow path for flow of water from the reservoir interior into said hot water tank, said second dispenser fitting defining a flow path coupled to said hot water tank for dispensing of water therefrom, and a second faucet valve mounted on said second dispenser fitting in an accessible position to dispense water from said hot water tank.

8. The water station of claim 7 wherein said hot water tank is suspended from said support platform.

9. The water station of claim 8 further including slide-fit connector means for removably connecting said hot water tank to said support platform in flow-coupled relation with the flow paths defined by said second slide-fit connector and said second dispenser fitting.

10. The water station of claim 1 further including baffle plate means for subdividing the reservoir interior into first and second chambers, a temperature control device in thermal communication with said first chamber to control the temperature of water therein, said at least one slide-fit connector being coupled to said first chamber when said reservoir is installed into said station housing, a second slide-fit connector on said support platform for engagement with said station housing upon installation thereof into said station housing, a second dispenser fitting on said support platform, said second slide-fit connector and said second dispenser fitting defining a flow path coupled to said second chamber upon installation of said reservoir into said station housing, and a second faucet valve mounted on said second dispenser fitting in an accessible position to dispense water from said second chamber.

11. A water station, comprising:

a reservoir having a hollow interior for receiving and storing a supply of water;

a station housing having a support platform for receiving and supporting said reservoir, said reservoir being adapted for slide-fit drop-in installation into said station housing and lift-out removal therefrom;

said support platform including first and second slide-fit connectors for engagement with said reservoir upon installation into said station housing, and first and second dispenser fittings;

said first slide-fit connector and said first dispenser fitting cooperatively defining a flow path coupled to the interior of said reservoir upon installation thereof onto said station housing;

a hot water tank mounted on said support platform, said second slide-fit connector defining a flow path coupled between the reservoir interior and the hot water tank upon reservoir installation into the station housing and said second dispenser fitting defining a flow path coupled to the hot water tank; and first and second faucet valves mounted respectively to said first and second dispenser fittings and manually operable to dispense water therefrom.

12. The water station of claim 11 wherein said hot water tank is suspended from said support platform.

13. The water station of claim 12 further including slide-fit connector means for removably connecting said hot water tank to said support platform in flow-coupled relation with the flow paths defined by said second slide-fit connector and said second dispenser fitting.

14. The water station of claim 11 wherein said support platform comprises a unitary plastic molding.

15. The water station of claim 11 wherein said support platform further includes means for supporting at least one temperature control device in thermal communication with water within the interior of said reservoir.

16. A water station, comprising:

a reservoir having a hollow interior for receiving and storing a supply of water;

a station housing having a support platform for receiving and supporting said reservoir, said reservoir being adapted for slide-fit drop-in installation into said station housing and lift-out removal therefrom;

baffle plate means dividing the interior of said reservoir into first and second chambers;

a temperature control device supported by said support platform in thermal communication with water within said first chamber to control the temperature thereof;

said first slide-fit connector and said first dispenser fitting cooperatively defining a flow path coupled to said first chamber upon installation of said reservoir to said station housing;

said second slide-fit connector and said second dispenser fitting cooperatively defining a flow path coupled to said second chamber upon installation of said reservoir into said station housing; and first and second faucet valves mounted respectively to said first and second dispenser fittings and manually operable to dispense water therefrom.

17. The water station of claim 16 wherein said support platform comprises a unitary plastic molding.

18. The water station of claim 16 wherein said temperature control device comprises a chiller probe supported by said platform to project upwardly therefrom.

* * * * *